United States Patent [19]

Mirande

[11] 3,999,496

[45] Dec. 28, 1976

[54] SWIVELING STRUT FAIRING FOR STEERING OF HYDROFOIL SHIPS

[75] Inventor: Pierre Marie Mirande, Bellevue, Wash.

[73] Assignee: The Boeing Company, Seattle, Wash.

[22] Filed: Nov. 24, 1975

[21] Appl. No.: 634,679

[52] U.S. Cl. ..... 114/280; 114/162

[51] Int. Cl.[2] ..... B63B 1/30

[58] Field of Search ..... 114/66.5 R, 66.5 H, 114/152, 162; 244/87; 115/70

[56] References Cited

UNITED STATES PATENTS

| | | | |
|---|---|---|---|
| 2,906,228 | 9/1959 | Wendel | 114/66.5 H |
| 3,421,468 | 1/1969 | Newsom | 114/66.5 H |
| 3,742,890 | 7/1973 | Hubbard et al. | 114/66.5 H |
| 3,804,047 | 4/1974 | Faber et al. | 114/66.5 H |
| 3,827,391 | 8/1974 | Stanberry et al. | 115/70 |

*Primary Examiner*—Trygve M. Blix
*Assistant Examiner*—Charles E. Frankfort
*Attorney, Agent, or Firm*—Nicolaas DeVogel

[57] ABSTRACT

A hydrofoil strut assembly for a hydrofoil ship. The assembly has two major parts, the first part serves as a strut and is mounted at one end to the ship's hull foundation and carries a hydrofoil at the other end; the second part serves as a rudder, completely envelopes the first part and is rotationally mounted thereabout. The rotational mounting is provided by an upper bearing and a lower bearing. The upper bearing connects the rudder to the strut so that all loads are transferred via the strut to the hull. The lower bearing aligns the rudder about the strut next to the hydrofoil and carries loads to the first part or strut structure.

4 Claims, 5 Drawing Figures

Fig. 1
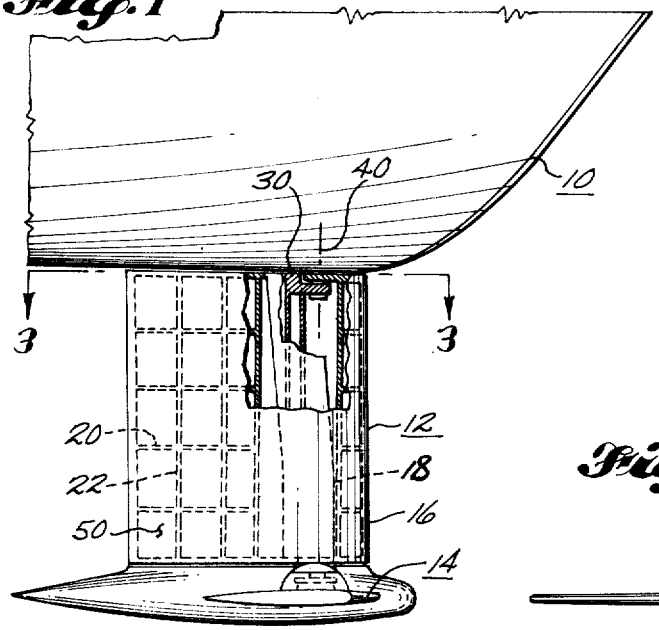
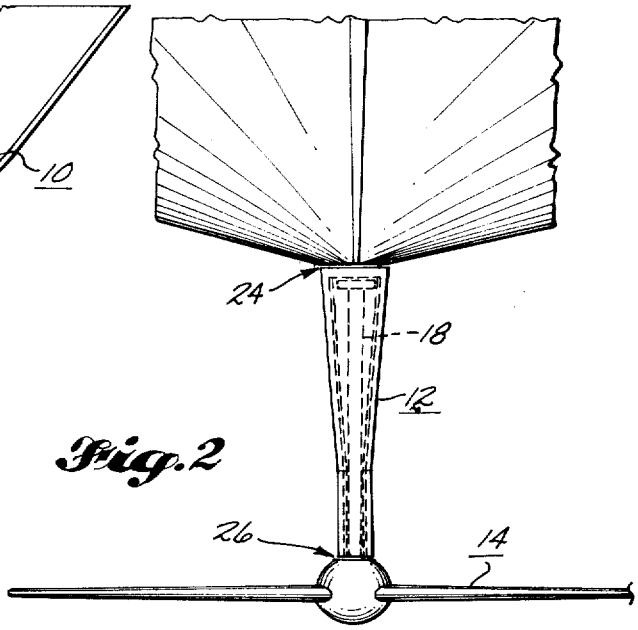
Fig. 2
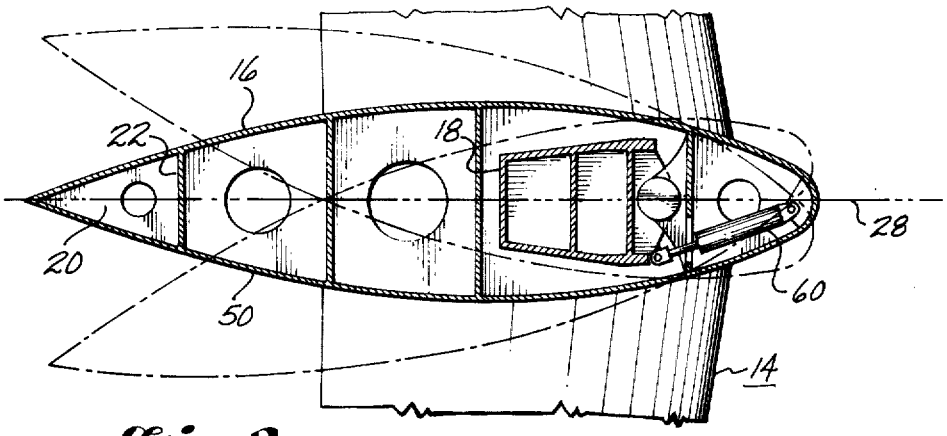
Fig. 3
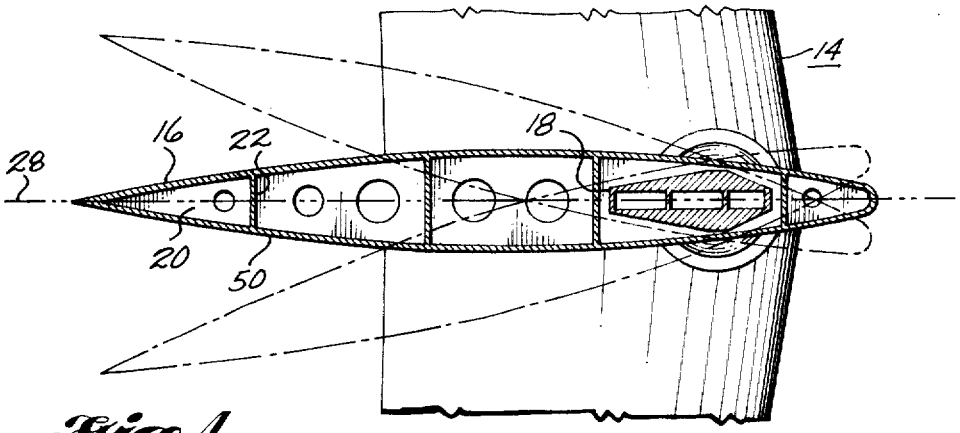
Fig. 4

SWIVELING STRUT FAIRING FOR STEERING OF HYDROFOIL SHIPS

BACKGROUND OF THE INVENTION

The steering of the forward strut in the hydrofoil "Canard" ship configuration or the aft strut in the hydrofoil "airplane" ship configuration is required in order to economically maneuver the hydrofoil ship.

The steering or rudder strut also provides structural support to a hydrofoil arrangement. Previously, the strut and foil have been steered as a unit.

However, advanced marine ships of the hydrofoil type will be larger and faster than the present versions and accordingly various problems occur. For instance, the steering of the strut with integrally connected foil assembly increases the steering torque requirement, overtaxes the hydraulic system and increases the steering mechanism's vulnerability to floating log collisions.

A prior attempt has been made to resolve the problem by swiveling a fairing around a cylindrical post or inner structural strut member with a series of bearings. This solution created other problems, such as:

1. The diameter of the post and bearings required to support the foils and the fairing loads is such that the thickness and chord of the fairing become very large, and increase drag and weight.

2. Flutter problems cannot be resolved, and 3. a hard stop for the fairing must be provided for, which is an additional feature and additional cost and weight.

Thus the steering concept must meet the requirements of a. providing structural support to the foil and other necessary components under the most severe loading conditions expected during operation;

b. provide for a rudder of narrow thickness for minimum drag;

c. provide for a hard-stop to prevent catastrophic failures;

d. provide a steering axis at approximately 20% of chord for stability, and e. provide for steering angles in the 12° – 15° range.

SUMMARY OF THE INVENTION

The present invention is particularly directed to advanced large hydrofoil ships where steering by strut flaps becomes impossible because of the enormous power and size of actuators required to overcome the flap's pivot momentum. The most effective steering solution for the larger and faster hydrofoil ships is the steering of the single strut about its longitudinal axis. However, the strut carries a foil arrangement which would move along and would cause heavy torque requirement in addition to other hereinbefore mentioned problems. Accordingly, this invention solves the problem of steering hydrofoil ships by providing for a strut fairing which pivots about an interior structural member which carries the foil arrangement. The major features of the present invention is to provide for a continuously efficient structural strut to transfer the foil and fairing bending moments and torque load to the hull foundation, and, furthermore, to provide for a minimum fairing thickness and low hydrodynamic drag, flutter-free structure, with low weight and the presence of hard stops in the event of steering system failure.

It is therefore an object of the present invention to provide for a steering strut for a hydrofoil ship which carries a foil arrangement and which strut steering movement action is independent from the foil arrangement.

It is a further object of the present invention to provide for a hydrofoil ship steering strut having a flutter-free low drag steering capability.

Additional objects, features and advantages will become evident from the following description taken in conjunction with the accompanying drawings.

DESCRIPTION OF THE DRAWINGS

FIG. 1 is a side view of a bow section of a hydrofoil ship of the "Canard" type, having a forward steerable strut as described in the present invention.

FIG. 2 is a front view of the same strut.

FIG. 3 is a section view of the strut shown in FIG. 1 taken along line 3—3.

FIG. 4 is a section view of the strut shown in FIG. 1 taken along line 4—4.

OPERATION OF THE INVENTION

Figure 5:
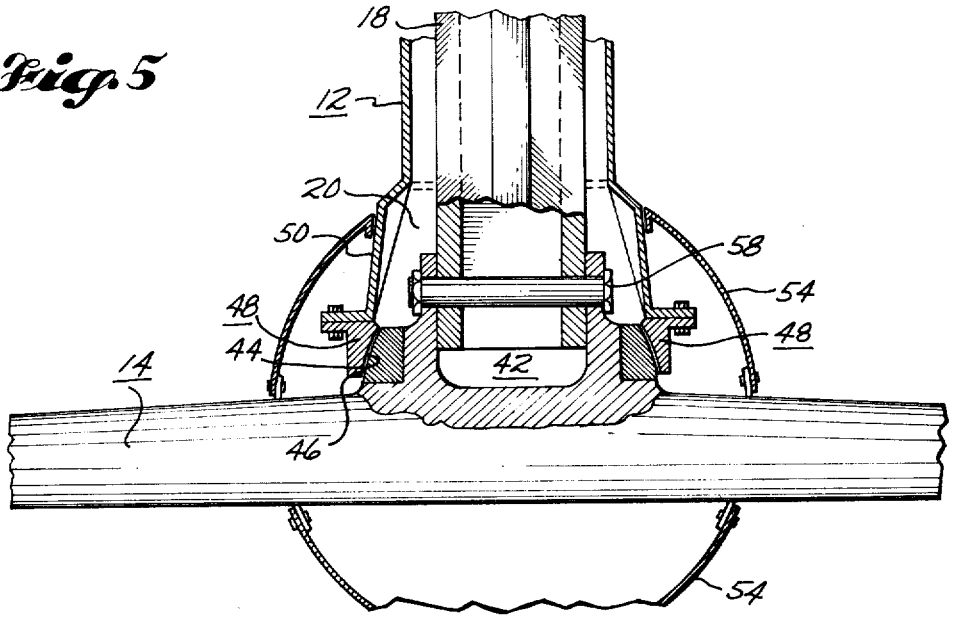
FIG. 5 is a detail of the lower bearing arrangement where the strut and foil are connected.

The drawings diagrammatically illustrate by way of example, not by way of limitation, a preferred form of the invention.

FIG. 1 discloses a typical bow of a hydrofoil ship 10 having a forward strut 12 which carries a hydrodynamic foil arrangement 14. The strut may be permanently connected to the ship 10 or may be of the retracted type which pivots out of the water in order to have a low depth for the ship in hullborne conditions. The strut comprises an assembly of two elements, an exterior fairing 16 having a hydrodynamic chord shape configuration and a structural interior support member 18. The fairing 16 is relatively light in weight and structurally built up similar to airplane wings having ribs or webs 20 and spars or support beams 22 covered by a skin 50. The root chord 24 is larger than the tip chord 26. The chord line 28 is substantially in the center of the fairing 16, dividing the same in two equal sections.

On the root chord 24, the rib or web 20 has an extended web 30 portion that forms the rotational hinge part of the bearing 40 which is preferably mounted onto the hull foundation or bow 10.

At the tip chord 26 (see FIG. 5), the skin 50 and rib 20 end into a junction 42 on which is mounted a bearing race 44. The bearing race 44 moves or slides about the inner or permanent non-moving bearing race 46 and together form the pod spherical bearing 48. The complete assembly is covered by a pod structure 54.

The second element of the strut 12 comprises the interior structural member 18 which is a built-up structural beam of a somewhat diamond cross-sectional shape which tapers from the hull toward the foil arrangement 14.

The diamond shape takes full advantage of the space available within the fairing 16 less the angular steering clearance required. The structural member 18 also provides routing for necessary mechanical, hydraulic and electrical systems necessary for foil operation, sensors and drives which may be required at the pod 54 or the foil arrangement 14.

The foil arrangement 14 is mounted to the structural member by fastening means 58. The over-all design of the steerable strut fairing provides for enough space at the location of the upper and lower bearing 40 and 48, respectively, so that the complete loads can easily be transferred to the hull foundation. A steering actuator 60 is arranged near the upper bearing 40 and mounted between the fairing web 20 and a non-movable portion such as the hull 10, or the structural member 18 so that the required steering torque can be obtained (see FIG. 3).

While there has been described what is at present considered to be the preferred embodiment of this invention, it will be obvious to those skilled in the art that various changes and modifications may be made therein without departing from the invention, and it is, therefore, aimed in the appended claims to cover all such changes and modifications as fall within the true spirit and scope of the invention.

Now, therefor, I claim:

1. A hydrofoil strut assembly for a hydrofoil ship comprising in combination:

a. an elongated built-up structural member connected with its upper end to said ship's hull and carrying a foil arrangement at its lower end;

b. a fairing enveloping said structural member;

c. bearing means mounted between said structural member and said fairing for providing rotation of said fairing about said structural member, said bearing means including a first bearing and a second bearing, said first bearing mounted with its first stationary portion attached to said structural member upper end and with its movable portion connected to said fairing, said second bearing being mounted between said fairing and said strut adjacent said foil arrangement, and d. actuating means connected between said fairing and said structural member for positioning said fairing in relationship to said structural member so that said fairing acts as a rudder.

2. A hydrofoil strut assembly for a hydrofoil vessel as claimed in claim 1 wherein said structural member has an average overall cross-section with a length that is larger than its width and wherein said length is disposed in a substantially parallel direction to said vessel's longitudinal axis.

3. A hydrofoil strut assembly for a hydrofoil ship comprising in combination:

a. an internal elongated built-up structural beam affixed to and extending substantially downward from said hydrofoil ship's hull and carrying a hydrodynamic foil arrangement at its lower end;

b. an external fairing having in cross-section a substantially symmetrical chord-shaped configuration enveloping said elongated structural beam;

c. bearing means mounted between said structural member and said fairing for allowing rotation of said fairing about said structural member, said bearing means including a stationary portion mounted onto said structural member and a movable portion mounted to said fairing, and d. actuating means connected between said fairing and said structural member for positioning said fairing in relationship to said structural member so that said fairing acts as a rudder.

4. A hydrofoil strut assembly for a hydrofoil vessel as claimed in claim 3 wherein said internal structural beam has an average overall cross-section with a length that is larger than its width and wherein said length is disposed in a substantially parallel direction to said vessel's longitudinal axis.

* * * * *